United States Patent [19]

Wilcox et al.

[11] 4,340,140

[45] Jul. 20, 1982

[54] PACKAGE CONSTRUCTION

[75] Inventors: Donald G. Wilcox, Seymour; Nobile Zambrano, Branford, both of Conn.

[73] Assignee: Show-Pak, Incorporated, New Haven, Conn.

[21] Appl. No.: 178,754

[22] Filed: Aug. 18, 1980

[51] Int. Cl.[3] ..... B65D 1/24; B65D 43/12

[52] U.S. Cl. ..... 206/373; 206/45.19; 220/469; 220/346

[58] Field of Search ..... 206/373, 372, 349, 45.19; 220/346, 469, 345

[56] References Cited

U.S. PATENT DOCUMENTS

| | | | |
|---|---|---|---|
| 2,941,691 | 6/1960 | Weinberg | 220/346 |
| 3,327,841 | 6/1967 | Schurman et al. | 206/45.19 |
| 3,759,413 | 9/1973 | Ardito | 220/469 |

*Primary Examiner*—William T. Dixson, Jr.
*Attorney, Agent, or Firm*—John A. Mitchell; Pasquale A. Razzano

[57] ABSTRACT

The disclosed package consists of a base having sidewalls defining a top opening providing access to the interior of the package and a flat flexible cover substantially complementary to the opening. The sidewalls have top edges, with the top edge of one wall located below the top edges of the other sidewalls. The base includes shoulders for supporting the cover below the top edge of the shorter of the sidewalls; and flanges or extensions project from the top edges of the other three walls to resist upward movement of the cover relative to the base while permitting the cover to be placed on the base by a sliding movement.

12 Claims, 6 Drawing Figures

FIG. 1
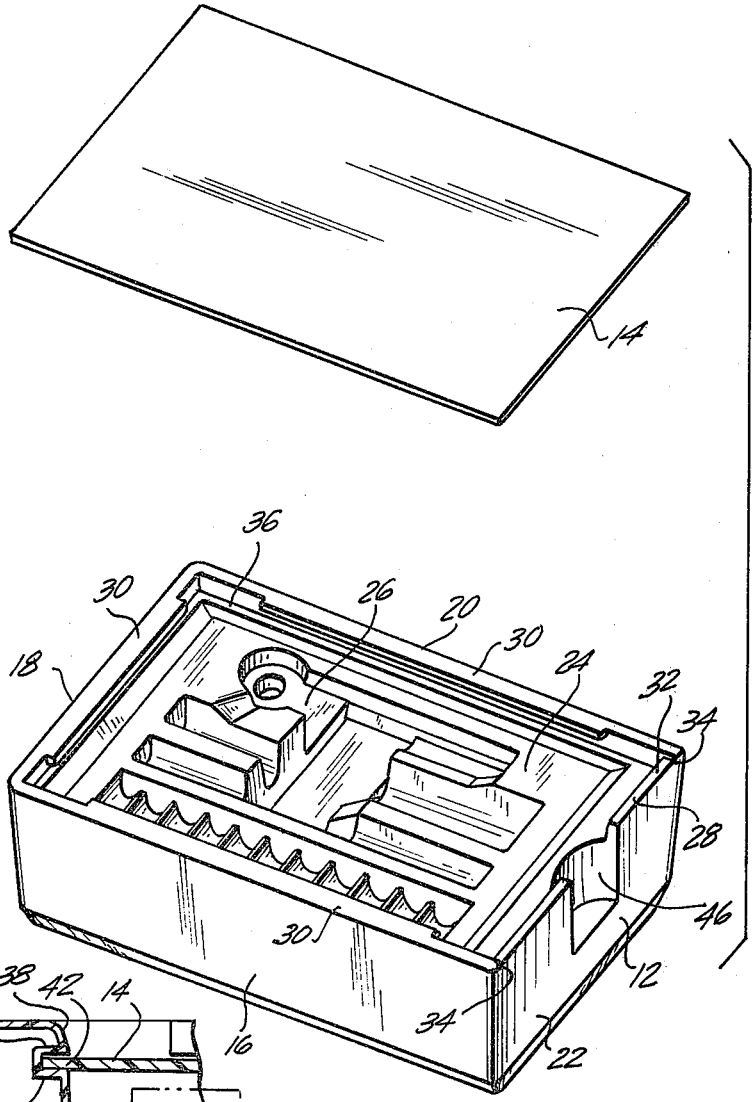
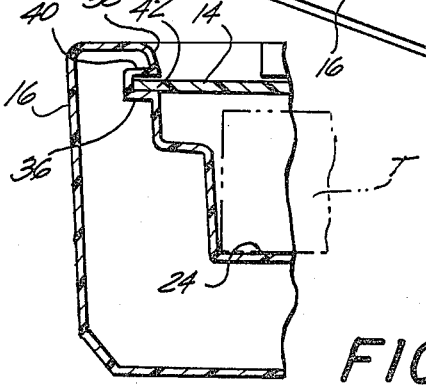
FIG. 5

FIG. 3
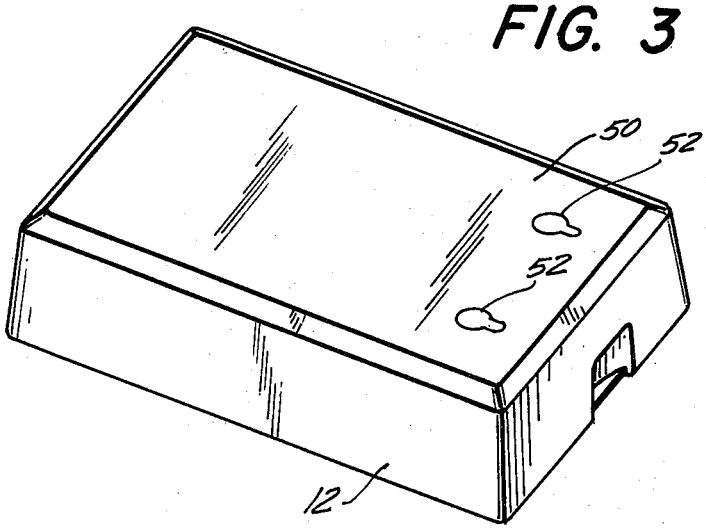
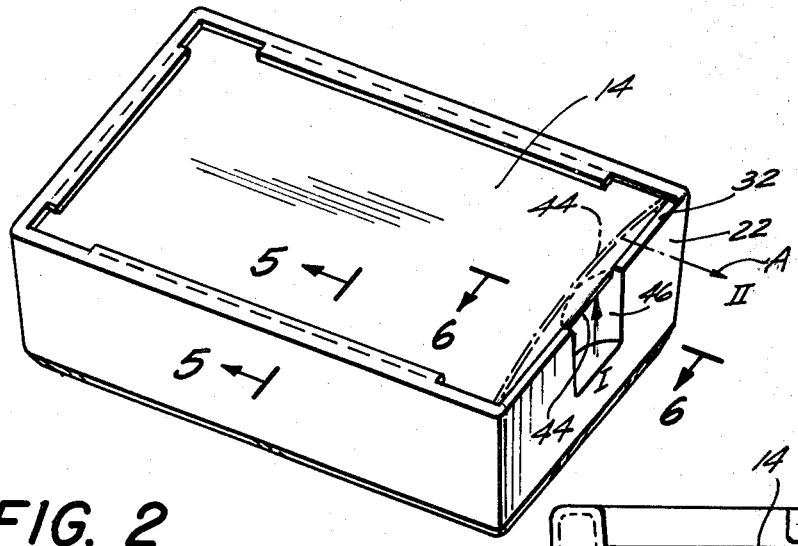
FIG. 2
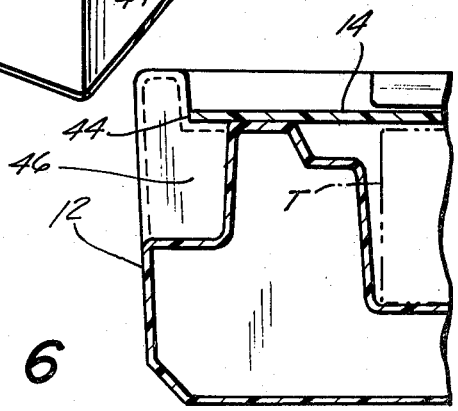
FIG. 6

PACKAGE CONSTRUCTION

The present invention relates to a package construction and, in particular, to a package having a cover which resists inadvertent removal.

The package construction of the present invention consists of a base having a plurality of sides, typically four, which define an open top. Each of the sides of the package has a top edge, with the top edge of one of the sides being somewhat lower or shorter than the top edges of the other side of the base. A support shoulder is formed within the package along the sidewalls below the level of the top edge of the lower side to support a flat flexible cover with a shape that is generally complementary to that of the top opening. Projecting flanges on at least some of the sidewalls, located above and in spaced relation to the shoulders, define slots in which the cover may slide. These flanges or projections resist removal of the cover in an upward direction, and also retain the cover in the package when the package is inverted.

By this construction the cover is held below the top edge of the lower most side wall, so that sliding movement of the cover when it is in the closed position is prevented, thereby resisting inadvertent removal of the cover from the package.

Preferably, the base of the package of the invention is blow molded. The construction described permits the molding of the flanges or projections on the base in a relatively simple and inexpensive operation to achieve the desirable effect of preventing inadvertent removal of the cover from the base.

Accordingly, it is an object of the present invention to provide an improved blow molded package construction.

Another object of the present invention is to provide a package construction which resists removal of a slidably positioned cover.

A still further object of the present invention is to provide a package construction having a slidably mounted cover which is held against removal by the package when the package is inverted.

The above, and other objects, features and advantages of this invention will be apparent in the following detailed description of an illustrative embodiment thereof, which is to be read in connection with the accompanying drawings, wherein:

FIG. 1 is an exploded perspective view of a package constructed in accordance with the present invention;

FIG. 2 is a perspective view of the package and top in their assembled or closed configuration;

FIG. 3 is an inverted perspective view of the package shown in FIGS. 1 and 2;

FIG. 5 is a sectional view taken along line 5—5 of FIG. 4; and

FIG. 6 is a sectional view taken along line 6—6 of FIG. 5.

Figure 4:
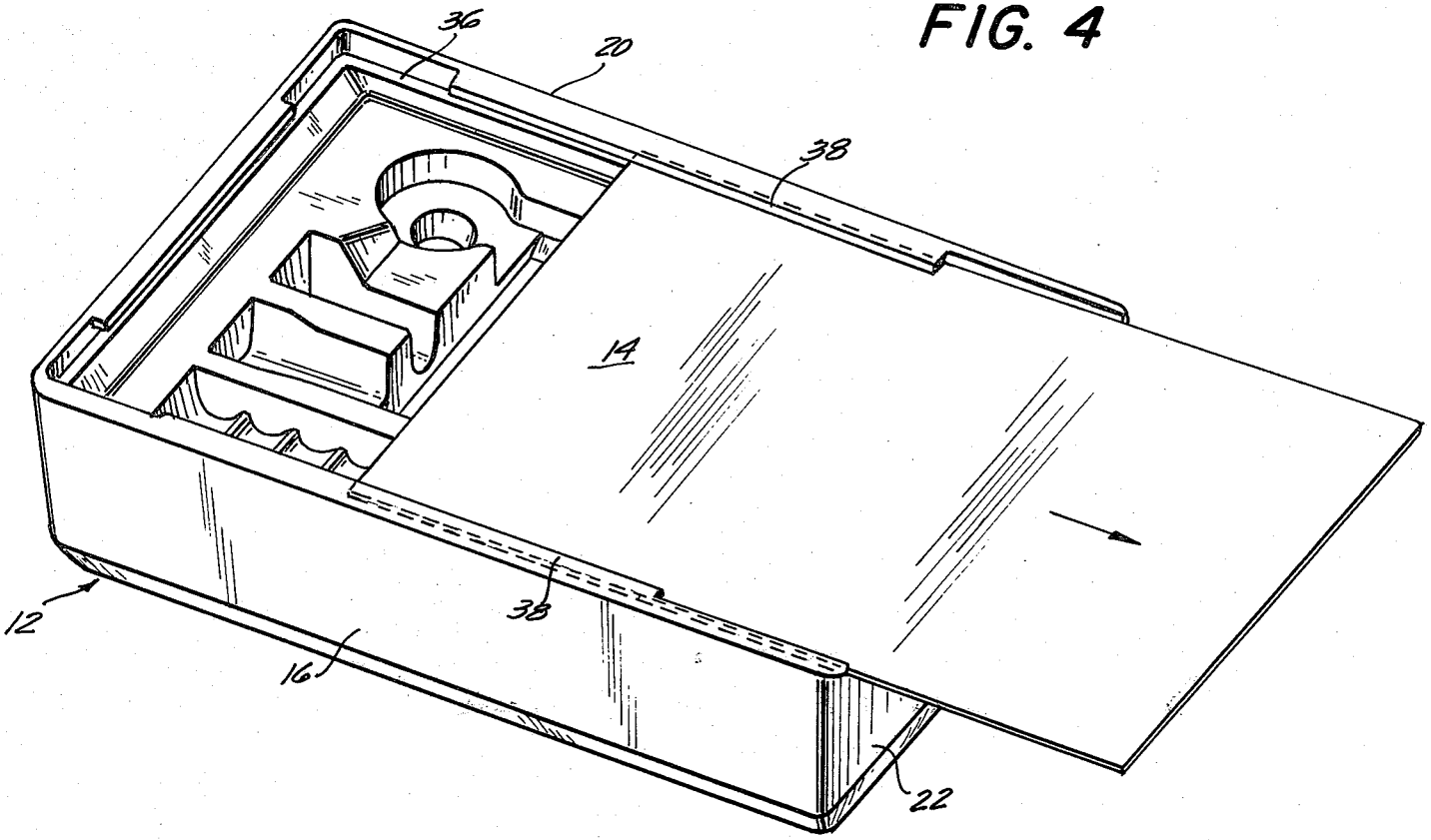
FIG. 4 is a perspective view, similar to FIG. 2, showing the sliding removal of the cover from the package.

Referring now to the drawings in detail, and initially to FIG. 1 thereof, package 10 includes a polygonal base 12 and a cover 14. The base is generally rectangular and has a plurality of sidewalls 16, 18, 20 and 22. The entire base, including its sidewalls, is preferably formed of a blow molded plastic material, in a known manner, and has an integral base panel 24. Recesses 26 are molded in panel 24 to accept articles to be stored in the package.

In the illustrative embodiment, recesses 26 are formed to accept a socket wrench set. The recesses are dimensioned relative to the tools to be received therein such that the upper surface of the tools all lie on substantially the same plane when in their respective recesses.

Each of the sidewalls includes an upper edge portion, with upper edge 28 of sidewall 22 being located at a level below the upper edges 30 of the remaining sidewalls. That is, edge 28 lies on a lower plane than edges 30 with respect to panel 24. This arrangement provides a recessed guide passage 32 between abutments 34 formed by top edges 30 of the sidewalls 16, 20 at sidewall 22. This entry recess, for cover 14, is slightly larger than the width of cover 14 so that the cover can be slid onto base 12 over edge 32 of sidewall 22.

Each of the sidewalls of the base has an integral shoulder 36 formed thereon for supporting cover 14 within the base. These shoulders extend along the entire length of each of the sidewalls, although that is not an absolute necessity for the construction of the base according to the present invention; i.e. the shoulders could be segmented if desired. Shoulders 36 are located within the base at a level which is below the level of the top edge 28 of sidewall 22. Preferably, the distance between the level or plane in which shoulders 36 lie and the level or plane in which top edge 32 of sidewall 22 lies is equal to or greater than the thickness of cover 14. Thus, when cover 14 is in position on shoulders 36, it is surrounded about its entire periphery by the inner surfaces of the sidewalls and cannot move laterally in any direction, even with respect to sidewall 22 (see FIG. 6).

To prevent inadvertent removal of cover 14 from base 12, even when the package is inverted, top edges 30 of the respective sidewalls 16, 18, and 20 include integrally formed blow molded extensions or flanges 38 projecting inwardly over shoulders 36 (see FIG. 5). These extensions, as seen in FIG. 1, do not extend along the entire length of the sidewalls in the illustrative embodiments. However, it is contemplated that these projections can extend completely about the internal peripheries of sidewalls 16, 18 and 20 if desired.

Each projection 38 includes a lower surface 40 which is spaced above shoulder 36 of base 12 by a dimension which is at least equal to the thickness of cover 14, and is preferably slightly greater than that thickness. In addition, surface 40 lies on a plane which is on the same level, or in the same plane, as the plane of top edge 32 of front edge 22, or slightly lower than such plane.

By this arrangement space 42 between surfaces 36, 40, defines slots which receives the peripheral edges of cover 14. As a result, cover 14 can be slid into position on package base 12, as seen in FIG. 4, by passing the cover over the top edge of wall 22 beneath extensions 38 on sidewalls 16, 20, and sliding the cover fully into position over shoulders 36. Since cover 14 is substantially complementary to the interior opening of the base defined by the sidewalls the cover will rest on shoulders 36 at a level below the level of the top edge 32 of sidewall 12 (see FIG. 6). Thus, once the cover is in position, it cannot move in any direction with respect the sidewalls, since the sidewalls, including sidewall 22 block such movement. In addition, should the package be inverted, as seen in FIG. 3, projections 38 prevent the cover from falling away from base 12. Moreover, shoulders 36 are located at approximately the same level, i.e. plane as the upper surfaces of the tools T (see FIG. 5) in the cavities 26 so that cover 14 retains the tools in the cavities and prevents them from from shifting during movement of the box.

When it is desired to remove cover 14 in order to expose the contents of the package, the cover is flexed slightly so that its edge 44, adjacent to sidewall 22, is raised above the top edge of the sidewall to permit the cover to be retracted in the direction of the arrow A in FIG. 2. To facilitate this movement, a recess 46 is formed in sidewall 22 and extends through the upper edge 32 of the sidewall, as seen in FIGS. 1 and 2. This recess provides a finger grip recess to enable the edge 44 of cover 14 to be grasped between the operator's fingers so as to flex the cover and pull it in the direction of the arrow A. The cover is then freed for sliding movement away from the base.

As seen in FIG. 3 the bottom wall 50 of base 12 may be provided with key hole shaped slots 52 for hanging the package on support screws in a wall or the like for display or storage purposes.

Accordingly, it is seen that a relatively simply constructed package is provided in which the cover for the package is restrained against inadvertent removal. The construction of the package is such that all of the components thereof, except for the cover, are integrally formed in a simple blow molding operation. The cover is safely retained within the base, without the need for any snap fitting or lock arrangements to retain it in place.

Although an illustrative embodiment of the invention has been described herein with reference to the accompanying drawings, it is to be understood that the invention is not limited to that precise embodiment, and that various other changes and modifications may be effected therein by one skilled in the art without departing from the scope or spirit of this invention.

What is claimed is:

1. A package comprising a base having a plurality of sides defining an open top, said sides each having a top edge, with the top edge of one of said sides being at a lower level than the top edges of the remainder of said sides, said sides each including a support shoulder for a package cover located on the interior of the package below the top edge of said one side and means associated with and spaced from at least some of said shoulders for resisting vertical removal of a cover supported on said shoulders; and a cover slidable across the top edge of said one side along the shoulders of at least some of the other sides, said cover having a periphery which is generally complementary to the periphery of said opened top whereby when the cover is slid into position over said shoulders it rests on the shoulders below the level of the top edge of said one sidewall which resists withdrawal of the cover from the package; said base having an article support panel formed therein extending between said sides below the level of said shoulders; and panels having recesses of predetermined shape formed therein to support articles of predetermined shape such that the upper surfaces of the supported articles all lie in substantially the same plane as said shoulders for retention in said recesses by said cover.

2. A package as defined in claim 1 wherein said base is formed of blow molded plastic.

3. A package as defined in claim 1 wherein said one sidewall has a recess formed therein on its outerside which extends through said top edge thereof to provide a finger grip area for the cover.

4. A package as defined in claim 1 wherein said shoulders are located at a level in said base which is below the top edge of said one side by a dimension which is at least equal to the thickness of said cover.

5. A package as defined in claim 4 wherein said cover is flexible.

6. A package as defined in claim 1 wherein said resisting means comprises a flange extending along at least a portion of the top edge of each of said other sides in spaced relation to said shoulders.

7. A package as defined in claim 6 wherein said flanges each have a lower surface lying in a plane which is at the same or a lower level than the level of the top edge of said one side.

8. A package as defined in claim 7 wherein said flanges are integral hollow blow molded extensions of said other sides.

9. A package comprising a blow molded polygonal base and a flat flexible cover, said base having a plurality of sides defining a top opening providing access to said base, each of said sides having a top edge, with the top edge of one side lying in a first plane and the top edges of the other of said sides lying in a second plane above said first plane, said sides each including a support shoulder for said cover lying in a third plane below the level of said first plane; and said other sides each including inwardly projecting extensions overlying at least a portion of the shoulders of their respective sides and spaced thereabove a distance which is at least equal to the thickness of said cover to define cover retention slots whereby said cover may be slid onto said base over the top edge of said one side into said slots for retention by said extensions on said shoulders below the level of the top of said one wall such that inadvertent removal of the cover from the base is blocked by said one wall; said extensions being blow molded with their associated sidewalls and having lower surfaces lying in a plane which is at the same level as or below said first plane.

10. A package as defined in claim 9 wherein said one sidewall has a recess formed therein on its outerside which extends through said top edge thereof to provide a finger grip area for the cover.

11. A package as defined in claim 10 wherein said shoulders are located at a level in said base which is below the top edge of said one side by a dimension which is at least equal to the thickness of said cover.

12. A package as defined in either of claims 8 or 9 wherein said base includes a bottom wall having at least one key hole slot formed therein to permit hanging of the package for display or storage purposes.

* * * * *